United States Patent [19]

Wood et al.

[11] 4,302,208

[45] Nov. 24, 1981

[54] GELLED FAE FUEL

[75] Inventors: Stanley E. Wood, Inyokern; Bertram O. Stull, Ridgecrest, both of Calif.

[73] Assignee: The United States of America as represented by the Secretary of the Navy, Washington, D.C.

[21] Appl. No.: 145,642

[22] Filed: May 1, 1980

[51] Int. Cl.[3] ..... C10L 7/04

[52] U.S. Cl. ..... 44/7 D; 102/363; 149/109.4

[58] Field of Search ..... 102/363; 44/7 D; 149/109.4

[56] References Cited

U.S. PATENT DOCUMENTS

| | | | |
|---|---|---|---|
| 2,993,768 | 7/1961 | Holze | 149/89 |
| 3,214,252 | 10/1965 | Lehmacher | 44/7 D |
| 3,471,344 | 10/1969 | Tarpley | 149/89 |
| 3,525,689 | 8/1970 | Marotta | 44/7 D |
| 3,539,406 | 11/1970 | Lissant | 44/7 D |
| 3,566,969 | 3/1971 | Hendrickson et al. | 149/89 |
| 3,940,443 | 2/1976 | Glass | 102/363 |
| 4,132,169 | 1/1979 | Gay et al. | 102/363 |
| 4,157,928 | 6/1979 | Falterman et al. | 102/363 |

*Primary Examiner*—Edward A. Miller

*Attorney, Agent, or Firm*—R. F. Beers; W. Thom Skeer; Lloyd E. K. Pohl

[57] ABSTRACT

A composition of matter consisting essentially of a polar fuel, a particulate gelling agent and a mixture of two polyfunctional alcohols, one having an ether linkage and the other having no ether linkage. The composition is useful as a fuel for a fuel air explosive device.

8 Claims, No Drawings

GELLED FAE FUEL

BACKGROUND OF THE INVENTION

1. Field of the Invention

This invention relates to fuels for fuel air explosive devices.

2. Description of the Prior Art

Fuel air explosive (FAE) devices have recently become a part of the arsenal of the United States military forces. These devices utilize a liquid fuel; means for dispersing the liquid fuel in the air to form a cloud when the device is dropped and initiated; and means for detonating the cloud after it is formed.

The fuels used in FAE devices are typically highly volatile liquids. The high volatility of these fuels makes them difficult to handle and leads to safety problems. For example, spillage of one of the highly volatile fuels from an FAE device combined with an inadvertent spark, lighted cigarette or the like may lead to an explosion or fire. Also, spillage, due to the liquid nature of the fuels, even if it doesn't lead to an unwanted explosion or fire, may result in fumes which are harmful to the health of military personnel who must necessarily be around the device. Further, the liquid nature of the fuels cause the fuels to spread over a large area if spillage occurs due to puncture of the container or the like. Accordingly, ways by which the safety of FAE devices can be improved are presently being sought.

SUMMARY OF THE INVENTION

A composition of matter which is useful as a fuel for FAE devices and which has safety characteristics which are improved over prior art FAE fuels is provided by this invention. The composition is made up by mixing a polar fuel, a particulate gelling agent, and a mixture of two polyfunctional alcohols. One of the alcohols contains an ether linkage. The other does not.

DESCRIPTION OF THE PREFERRED EMBODIMENTS

The composition of matter of this invention is made up by mixing (1) a polar fuel; (2) finely divided silicon dioxide, carbon black, aluminum oxide and other particulate gelling agents; and (3) a mixture of (a) a polyfunctional alcohol which has an ether linkage and (b) polyfunctional alcohol which has no ether linkage.

Many polar fuels which have been previously disclosed as being useful as FAE fuels may be used in the practice of this invention. Examples of fuels that may be used in the practice of this invention are propylene oxide, butylene oxide, diethyl ether and various other volatile liquid organic compounds.

Finely divided silicon dioxide is commercially available under the tradename Cab-O-Sil. It is widely used for many purposes. Carbon black and finely divided aluminum oxide are also readily available.

Examples of polyfunctional alcohols which contain ether linkages and are suitable for use in the practice of this invention are glycol ethers such as triethylene glycol, diethylene glycol and tetraethylene glycol.

Examples of polyfunctional alcohols which contain no ether linkage and are suitable for use in the practice of this invention are alcohols such as glycerine and ethylene glycol.

It has been found that the two aforementioned types of polyfunctional alcohols, i.e., those containing ether linkages and those containing no ether linkages, must be combined in the practice of this invention. A gel will form even if only one type is used. However, if a non-ether alcohol such as glycerine is used alone, the gel forms too quickly and the resulting gel is too viscous for use in an FAE device. On the other hand, if only a polyfunctional alcohol containing an ether linkage is used, the time that it takes a gel to reform after it has been sheared by vibration of the device or the like is excessively long. Neither of these problems arises when the two alcohol types are used in conjunction with one another.

In tests leading to this invention, various compositions were utilized. It was found that the amount of finely divided silicon dioxide or other particulate gelling agent added could be varied in a manner whereby it made up from about 8 to about 10 weight percent of the composition and that the amount of alcohol mixture added could be varied in a range where it made up from about 1 to 2 weight percent of the composition. The polar fuel, of course, made up the balance of the composition.

It was further found that the ratio by weight of the two types of polyfunctional alcohols in the alcohol mixtures could be varied in the range of from 40/60 to 60/40.

As long as the weight percentages of the various ingredients of the composition were kept within the ranges set forth above, the resulting gel could be used in state-of-the-art FAE hardware and fuel air explosions were produced upon initiation of the devices. The tests further indicated that the best mode or preferred gel for practicing the invention is represented by a composition made up by mixing 90 weight percent propylene oxide, 8.5 weight percent finely divided silicon dioxide and 1.5 weight percent of a 50/50 mixture of glycerine and triethylene glycol.

The fuel compositions of this invention may be prepared outside of an FAE device and later be pumped in. The gels are thixiotropic which substantially prevents spreading if spillage occurs but shear thin so that they can be pumped.

What is claimed is:

1. A composition of matter consisting essentially of (1) a polar fuel; (2) a particulate gelling agent; and (3) a mixture of a first polyfunctional alcohol and a second polyfunctional alcohol, said first polyfunctional alcohol having an ether linkage and said second polyfunctional alcohol having no ether linkage.

2. A composition of matter according to claim 1 wherein said polar fuel is selected from the group consisting of propylene oxide, butylene oxide, and diethyl ether.

3. A composition of matter according to claim 2 wherein said first polyfunctional alcohol is selected from the group consisting of triethylene glycol, diethylene glycol and tetraethylene glycol and wherein said second polyfunctional alcohol is selected from the group consisting of glycerine and ethylene glycol.

4. A composition of matter according to claim 3 wherein said composition contains from about 1 to about 2 weight percent of said mixture of alcohols and from about 8 to about 10 weight percent of a particulate gelling agent selected from the group consisting of silicon dioxide, carbon black and aluminum oxide.

5. A composition of matter according to claim 4 wherein said mixture is formed from about 60 to about 40 weight percent of said first polyfunctional alcohol and from about 40 to about 60 weight percent of said second polyfunctional alcohol.

6. A composition of matter according to claim 5 which contains 8.5 weight percent particulate gelling agent and 1.5 weight percent mixture formed from a 50/50 mixture by weight of said first and said second polyfunctional alcohol.

7. A composition of matter according to claim 6 wherein said polar fuel is propylene oxide, said first polyfunctional alcohol is triethylene glycol and said second polyfunctional alcohol is glycerine.

8. A composition of matter according to claim 7 wherein said particulate gelling agent is silicon dioxide.

* * * * *